US009096820B2

(12) United States Patent
Van Lare et al.

(10) Patent No.: US 9,096,820 B2
(45) Date of Patent: Aug. 4, 2015

(54) COATED PARTICLES OF A GLUMATIC ACID N,N-DIACETATE CHELATING AGENT

(75) Inventors: Cornelis Elizabeth Johannus Van Lare, Wijchen (NL); Roy Gérard Doppen, Deventer (NL)

(73) Assignee: AKZO NOBEL CHEMICALS INTERNATIONAL B.V., Amersfoort (NL)

( * ) Notice: Subject to any disclaimer, the term of this patent is extended or adjusted under 35 U.S.C. 154(b) by 453 days.

(21) Appl. No.: 13/515,535

(22) PCT Filed: Dec. 21, 2010

(86) PCT No.: PCT/EP2010/070328

§ 371 (c)(1),
(2), (4) Date: Jun. 20, 2012

(87) PCT Pub. No.: WO2011/076769

PCT Pub. Date: Jun. 30, 2011

(65) Prior Publication Data

US 2012/0252708 A1 Oct. 4, 2012

Related U.S. Application Data

(60) Provisional application No. 61/292,320, filed on Jan. 5, 2010.

(30) Foreign Application Priority Data

Dec. 24, 2009 (EP) ..... 09180722

(51) Int. Cl.
*C11D 17/00* (2006.01)
*C11D 3/33* (2006.01)

(52) U.S. Cl.
CPC ..... *C11D 17/0039* (2013.01); *C11D 3/33* (2013.01)

(58) Field of Classification Search
CPC ..... C11D 17/0039; C11D 3/33
USPC ..... 507/241; 252/180; 427/314; 510/441; 562/573
See application file for complete search history.

(56) References Cited

U.S. PATENT DOCUMENTS 3,629,329 A 12/1971 Shen et al.
3,962,110 A 6/1976 Tate (Continued)

FOREIGN PATENT DOCUMENTS

CN 101351539 A 1/2009
DE 19937345 A1 2/2001

(Continued)

OTHER PUBLICATIONS

European Seach Report dated Jun. 14, 2010 for related application EP 09180722.2.

(Continued)

*Primary Examiner* — Frances Tischler
(74) *Attorney, Agent, or Firm* — Sandra B. Weiss

(57) ABSTRACT

Process to prepare coated particles containing a particle and a coating, wherein the particle contains glutamic acid N,N-diacetic acid or a (partial) salt thereof of the formula HnYm-GLDA, wherein Y is a cation selected from the group of sodium, potassium, lithium, and mixtures thereof, n+m=4, in which the particle is made from a solution containing glutamic acid N,N-diacetic acid or a partial salt thereof that has a pH of between 4 and 11, and subsequently or simultaneously the coating is applied on the particle, to an intermediate particle of HnYm-GLDA, wherein n is 0.1-3.2 and m is 0.8-3.9, the coated particle obtainable with the process, and the use thereof.

9 Claims, 4 Drawing Sheets

(56) References Cited

U.S. PATENT DOCUMENTS

| | | | | |
|---|---|---|---|---|
| 5,948,748 | A * | 9/1999 | Hagino et al. | 510/480 |
| 5,981,789 | A | 11/1999 | Hickey et al. | |
| 2008/0045430 | A1 | 2/2008 | Witteler et al. | |
| 2008/0113894 | A1 * | 5/2008 | Enkel et al. | 510/441 |
| 2008/0300159 | A1 | 12/2008 | Seebeck et al. | |
| 2009/0075855 | A1 * | 3/2009 | Gibis et al. | 510/224 |

FOREIGN PATENT DOCUMENTS

| | | | |
|---|---|---|---|
| EP | 0678572 | A1 | 10/1995 |
| EP | 0845456 | A2 | 6/1998 |
| EP | 0884381 | A1 | 12/1998 |
| EP | 1792876 | A1 | 6/2007 |
| EP | 1803801 | A1 | 7/2007 |
| GB | 1300507 | | 12/1972 |
| GB | 2415695 | A | 1/2006 |
| WO | WO 96/25481 | | 8/1996 |
| WO | WO 98/03620 | | 1/1998 |
| WO | WO 01/12768 | A1 | 2/2001 |
| WO | WO 03/097784 | A1 | 11/2003 |
| WO | WO 2006/002954 | A1 | 1/2006 |
| WO | WO 2006/003434 | A1 | 1/2006 |
| WO | WO 2006/059811 | A1 | 6/2006 |
| WO | WO 2007/052004 | A1 | 5/2007 |
| WO | WO 2008/065109 | A1 | 6/2008 |
| WO | WO 2009/103822 | A1 | 8/2009 |

OTHER PUBLICATIONS

International Search Report dated May 10, 2011 for related application PCT/EP2010/070328.

Kirk Othmer Encyclopedia of Chemical Technology, vol. 16, Microencapsulation, pp. 438-463 by C. Thies: John Wiley & Sons Inc. 2001.

E. Teunou, D. Poncelet, "Batch and continuous fluid bed coating review and state of the art", J. Food Eng. 53 (2002), 325-340.

Office Action from Chinese equivalent application No. 201080058421.X (just translation), Oct. 30, 2013.

Machine Translation of DE 19937345 A1.

* cited by examiner

COATED PARTICLES OF A GLUMATIC ACID N,N-DIACETATE CHELATING AGENT

This application is the U.S. National Phase of PCT/EP2010/070328 filed on Dec. 21, 2010 and claims the benefit of U.S. Provisional Application No. 61/292,320 filed on Jan. 5, 2010 and European Application No. 09180722.2 filed on Dec. 24, 2009, the contents of each of which are incorporated herein by reference.

The invention relates to coated particles of (salts of) glutamic acid N,N-diacetic acid, a chelating agent of the formula COOH—CH(—$CH_2$—$CH_2$—COOH)—N—($CH_2$—COOH)$_2$, abbreviated as GLDA, to processes to produce said particles, to an intermediate particle in the process, and to the use of such coated particles.

The detergent market is currently undergoing important changes. Due to ecological and regulatory reasons the use of phosphate in high concentrations in detergent formulations is to be banned altogether or must at least be greatly reduced. The formulators of detergent products have to find alternatives to replace the phosphate compounds, with the most promising replacements being biodegradable chelating agents such as GLDA. Such chelating agents are used in a concentration from 5% to 60%. Many detergent formulations contain co-builders, which are typically polymers or phosphonates. These co-builders are present in formulations in a concentration from 1% to 50%.

In powder or tabs detergent formulations, solid raw materials are required by the formulator. In for example automatic dishwashing (ADW) applications, the raw materials have to be in granule form to improve the tabletting and solids handling of the formulation. These granules typically have a size comprised between 100 and 3,000 microns. The usual form in which glutamic acid N,N-diacetic acid (GLDA) is available is a liquid with an active content from 35% to 50%. After drying the substance, the powder or granules, especially when obtained in the amorphous state, show extent hygroscopic properties, which is unacceptable for the ADW formulators. Moreover, the granules obtained from the granulation process are brittle and thus cannot grow easily to the required size, resulting in slow processing and lots of fines. In addition, whether in powder or granule form, the (amorphous) chelating agent GLDA exhibits hygroscopic properties, rendering the material sticky and thus introducing storage, handling, and manufacturing problems. Flow properties of particles are critical in many ways. During manufacture of the particles themselves, they must flow smoothly relative to one another, e.g. in a fluid bed. Additionally, they must then be successfully transported to storage and transport containers. Finally, they must again be transported from storage and fed into a powder or tablet manufacturing facility. Flow problems arise due to several causes. For chelating agents, poor flow can be due to low glass transition temperatures, tackiness, wetness, too small particles, and physical entanglement of multifaceted, irregularly shaped particles.

GLDA will definitely move into the ADW market and likely into many other fields where a strong, green chelate is needed. The term "green" here denotes materials with a high renewable carbon content, a sustainable environmentally friendly production process, and/or a positive biodegradability assessment. While the state of the art builders used in detergent formulations, such as sodium tripolyphosphate (STPP) and nitrilo triacetic acid (NTA), do not require a co-granulation or coating process, the hygroscopic, dusty, and sticky properties of solid spray dried GLDA will make co-granulation or coating highly desirable.

Plain mixtures of chelating agent and additives are known in the art. Such mixtures are disclosed for example in EP 884 381, which document discloses a mixture of GLDA, an anionic surfactant, a salt of a polymer comprising carboxylic acid units, and a crystalline aluminosilicate at specific proportions. EP 1 803 801 also discloses a mixture of GLDA. This document deals with a granulate or powder comprising a mixture of GLDA and a polymer chosen from the group of polyvinyl alcohols, polyvinyl pyrrolidones, polyalkylene glycols, and derivatives thereof.

However, mixing GLDA and other additives will have hardly any beneficial effect in reducing the hygroscopic behaviour of the chelating agent.

To improve the hygroscopic properties of GLDA, it has been found to be better to make a coated particle containing a particle and a coating, wherein the particle contains GLDA.

When making a coated particle of glutamic acid N,N-diacetic acid (wherein GLDA is in the form of the full acid, taking the formula COOX—CH(—$CH_2$—$CH_2$—COOX)—N—($CH_2$—COOX)$_2$, each X is a hydrogen atom), a number of disadvantages are experienced that have not yet been acknowledged in the art, which are caused by the material having such a low softening point that coating it will hardly lead to a stable coated particle. Moreover, the low softening point limits the temperature inside the spray granulator and as a result it reduces capacity. On the other hand, when making a coated particle of the full salt of GLDA (wherein GLDA is in the form of the tetraanion, looking at the formula COOX—CH(—$CH_2$—$CH_2$—COOX)—N—($CH_2$—COOX)$_2$, wherein each X is not a hydrogen atom but an—alkalimetal-cation) problems are experienced also, as the full salt of GLDA shows little coherence and is so brittle that it cannot be decently subjected to a coating step.

Figure 1:
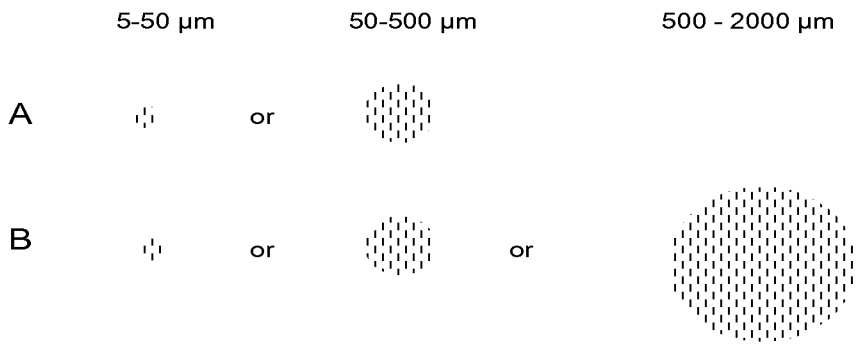
FIGS. 1A-B: State of the art particles that are not coated.

The object of the present invention is to provide a process to make coated particles of GLDA, wherein the chelating agent is not only separated from the environment by a suitable coating but wherein the above problems in making the coated particle are avoided. Another object of the invention is to provide stable coated particles of GLDA.

These objectives are achieved by the present invention, which provides a process to prepare coated particles containing a particle and a coating, wherein the particle contains glutamic acid N,N-diacetic acid or a (partial) salt thereof of the formula HnYm-GLDA, wherein Y is a cation, selected from the group of sodium, potassium, lithium, and mixtures thereof, n+m=4, in which process the particle is made from a solution containing the glutamic acid N,N-diacetic acid or a partial salt thereof that has a pH of between 4 and 11 when measured as a 1% solution in water, and subsequently or simultaneously the coating is applied on the particle.

The pH as given in this specification, unless indicated differently, is the pH as would be measured using a 1% solution of the reactants in $H_2O$. This does not, however, mean that the process needs to be performed in a 1% solution in water.

It was found that if the process is performed at high (alkaline) pH, the GLDA-containing material to be subjected to the coating process in many cases is so brittle that coating it is hard, moreover, because any preformed particles easily fragment and give a fine powder during processing. Apparently, the presence of (traces of) free caustic (NaOH or KOH) in the liquid to be spray granulated is too much for production of a good non-brittle granule. At the same time, it was found that if the process is performed at low (acidic) pH, due to a low softening point of the GLDA chelating agent, the GLDA-containing materials are sticky, which makes coating the GLDA-containing material also hard. It was additionally found that GLDA at a low pH generally is less hygroscopic than at a high pH. Nevertheless, it was also established that reducing the hygroscopicity by lowering the pH by acidification makes the GLDA (starting) materials more expensive, which is undesired from an economic point of view. The present invention, hence, represents the best balance in reducing hygroscopicity by coating GLDA, choosing the right pH range for the GLDA solutions used in the process and avoiding unnecessary costs.

The present invention additionally provides a coated particle containing a particle and a coating, wherein the particle contains glutamic acid, N,N-diacetic acid or a (partial) salt thereof, while the coated particle has, respectively, 0.1 to 3.2 hydrogen cations exchangeably available per GLDA anion.

Preferably, the particle comprises HnYm-GLDA, wherein m is 0.8 to 3.9 and n is 0.1 to 3.2. However, also particles wherein the values of m and n are different can be used. In such event, other components in the particle or in the coating should be available to exchange protons with the GLDA (i.e. accept therefrom or provide thereto), effectively causing 0.1 to 3.2 hydrogen atoms to be so-called "exchangeably available" per GLDA anion.

The present invention also covers the intermediate for the above process that provides a structural contribution to the features of the process of the present invention and the coated particles obtainable with the process. Accordingly, the present invention provides a particle containing glutamic acid N,N-diacetic acid or a partial salt thereof of the formula HnYm-GLDA, wherein m is 0.8 to 3.9, n is 0.1 to 3.2, n+m=4, and Y is a cation selected from the group of sodium, potassium, lithium, and mixtures thereof.

It may be noted that documents like WO 2006/003434 and GB 2415695 describe particles of other chelating agents than GLDA, for instance of methylglycine N,N-diacetic acid coated with polymeric materials such as polyethylene glycol and polyvinylpyrrolidone. In addition to the fact that these documents do not relate to coated particles of GLDA, also no disclosure or suggestion is made of coating the chelating agent at a specific pH range.

The term "coated particles" as used throughout this application is meant to denote all particles (e.g. powder or granules) containing GLDA in a core ("the particle") which have been encapsulated, coated, matrix coated, or matrix encapsulated, with at least one other material ("the coating"), as a consequence of which the particles have other physical characteristics than the particle without this coating. The coated particles can for instance have a modified colour, shape, volume, apparent density, reactivity, durability, pressure sensitivity, heat sensitivity, and photosensitivity compared to the original particle.

The coating surrounding the GLDA-containing particle can, for example, be a material that will act to sufficiently delay the GLDA in the particle from absorbing moisture, thereby reducing the rate of particles sticking together or forming a solid mass. At the same time, the coating layer should preferably be sufficiently readily water-soluble in order to release the GLDA or other chelating agent sufficiently fast in a final application wherein this is desired. Further, the particle once formulated will preferably provide a stable particle size that will not change during storage or transportation. Further, the GLDA or other chelating agent in the (structured) particles can be protected from the effects of UV rays, moisture, and oxygen by the coating. Chemical reactions between incompatible species of particles can be prevented due to the fact that the coating and the particles may exhibit greatly improved storage, handling, and manufacturing properties.

In a preferred embodiment of the invention, m is 1.5-3.7, most preferably m is 2.5-3.6.

In another preferred embodiment of the process of the invention, the coating is applied on the particle containing GLDA, with the particle being made from a GLDA-containing solution having a pH between 5 and 10.

It should be understood that in one embodiment the coated particles of the invention may in addition to GLDA contain another chelating agent. The other chelating agent can in one embodiment be selected from the group of EDDS (ethylenediamine N,N'-disuccinic acid), IDS (iminodisuccinic acid), NTA (nitrilotriacetic acid), or MGDA (methylglycine-N,N-diacetic acid), one of their salts, or a mixture two or more of these compounds.

The amount of GLDA in the coated particle in one embodiment is at least 30 wt %, more preferably at least 50 wt %, even more preferably at least 60 wt %, and up to 95 wt % on the basis of the total weight of the particle.

Additionally, it should be understood that the coated particles of the invention may contain two or more coating materials.

The coating may be any material that is suitable to achieve the above technical effects and in a preferred embodiment can be chosen from the group of scale-inhibiting additives, anti-blocking agents, protective colloids, and other water-soluble polymers.

Preferably in the process to prepare coated particles in accordance with the invention, the GLDA-containing particle is in substantially dry form, wherein substantially dry means that the GLDA-containing particle has a water content of below 10 wt %, preferably of below 6 wt %, on the basis of (total) solids.

Coated particles of GLDA of the invention may take several different forms depending on the processing conditions and the choice of materials.

Referring to the Figures, they provide an illustration of several particles as further described below.

FIGS. 1A-B depict state of the art particles that are not coated.

FIG. 1A depicts schematically two different median particle sizes for a dried chelating agent. For example, 5-50 μm particles can be made (e.g. by spray drying) or 50-500 μm particles can be made (e.g. by fluid bed agglomeration).

FIG. 1B depicts schematically that when a structuring agent is used to provide more robust granules, the maximum size of the granules created (e.g. by fluid bed granulation) can be increased to 3,000 μm.

FIGS. 2A-C depict coated particles of this invention.

FIG. 2A depicts the coated particles of this invention, where small 5-50 μm particles are coated in a continuous matrix of coating, the matrix encapsulation coating is acquired by spray drying with a high amount of coating. FIG. 2B depicts a particle of this invention in which a set of larger granules (or structured granules) are coated with a thin layer of a coating. FIG. 2C e.g. depicts the coating of a large structured granule in which an exterior polymer coating is created around an inner structured core.

Figure 2:
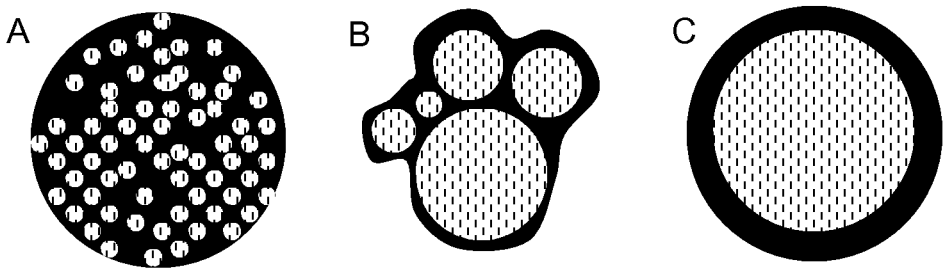
FIGS. 2A-C: Coated particles of the present invention.

It is known to those skilled in the art that the mechanical properties of the coating material can lead preferentially to the different coated particles shown in FIG. 2. Each particle can exhibit the improved qualities of the current invention and will exhibit a number of the different advantages. For instance, the coated particle depicted schematically by FIG. 2C will have the lowest surface area, due to the large particle size, and therefore the thickest layer of coating for a particular coating to particle weight ratio. This coated particle, however, may require the use of a structuring agent to provide a robust inner structured particle. However, in cases where little structuring material is desired, a coated particle more similar to FIG. 2A may be created.

This invention also covers the use of the coated particles in detergents, agriculture, in oil field applications, in water treatment, and other applications that require or benefit from the multiple benefits provided by this invention, i.e. the dissolution of crystals/scale, the sequestration of metal ions which can otherwise lead to precipitation, and the inhibition of scale growth. One preferred embodiment of this invention is the use of the coated particles in automatic dish washing. Another preferred embodiment of this invention is the use of the coated particles in oil well completion, stimulation, and production operations.

The scale-inhibiting additive suitable as coating can be a salt like a citrate, silicate, polycarboxylate or carbonate salt, such as the alkali metal salt of any of these, or a scale-inhibiting polymer. The scale-inhibiting polymer found to be functional as a coating can have a variety of chemical forms and specifically is selected from synthetic, natural, and hybrid scale-inhibiting polymers. The synthetic polymer includes selected levels of carboxylation, sulfonation, phosphorylation, and hydrophobicity to give good film-forming and humidity resistance as well as good co-building and crystal growth inhibition properties. The natural polymers are likewise prepared with a combination of molecular weight modification, carboxylation, sulfonation, phosphorylation, and hydrophobic properties to give good co-building and crystal growth inhibition properties. The hybrid polymers combine natural and synthetic monomers and polymers to give good co-building and crystal growth inhibition properties.

The advantage of using scale-inhibiting polymers and/or salts as a coating is that these polymers can be or are already used as co-builder in most of the detergent formulations and will therefore have a beneficial effect during the wash. Therefore, the current invention gives a superior product form for the chelating agent and the coating material also provides other benefits such as co-builder or crystal growth inhibition. Also, such coated particles of the present invention have excellent flow properties.

The protective colloid suitable as a coating is generally a water-soluble polymer, wherein water-soluble means a solubility of at least 1 wt %, preferably at least 5 wt %, more preferably at least 10 wt % in water at 25° C.

The protective colloid may be a synthetic polymer, but it can also be a biopolymer such as a polysaccharide or a peptide, each of which may be of natural origin or may have been prepared. The polymer may be synthetically modified.

Biopolymers and their derivatives that are suitable as a protective colloid are e.g. cold water-soluble polysaccharides and polysaccharide ethers, such as for instance cellulose ethers, starch ethers (amylose and/or amylopectin and/or their derivatives), guar ethers, dextrins and/or alginates. Also synthetic polysaccharides such as anionic, nonionic or cationic heteropolysaccharides can be used, in particular xanthan gum, welan gum and/or diutan gum. The polysaccharides can be, but do not have to be, chemically modified, for instance with carboxymethyl, carboxyethyl, hydroxyethyl, hydroxypropyl, methyl, ethyl, propyl, sulfate, phosphate and/or long-chain alkyl groups. Preferred usable peptides and/or proteins are for instance gelatine, casein and/or soy protein. Quite especially preferred biopolymers are dextrins, starches, starch ethers, casein, soy protein, gelatine, hydroxyalkyl-cellulose and/or alkyl-hydroxyalkyl-cellulose, wherein the alkyl group may be the same or different and preferably is a $C_1$- to $C_6$-group, in particular a methyl, ethyl, n-propyl and/or i-propyl group.

Synthetic, water-soluble organic polymers can consist of one or several polymers, for instance one or more polyvinyl pyrrolidones and/or polyvinyl acetals, optionally containing ethylene (co)monomers, with a molecular weight of 2,000 to 400,000, fully or partially saponified polyvinyl alcohols and their derivatives, which can be modified for instance with amino groups, carboxylic acid groups and/or alkyl groups, with a degree of hydrolysis of preferably about 70 to 100 mol. %, in particular of about 80 to 98 mol. %, and a Höppler viscosity in 4% aqueous solution of preferably 1 to 100 mPas, in particular of about 3 to 50 mPas (measured at 20° C. in accordance with DIN 53015), as well as melamine formaldehyde sulfonates, naphthalene formaldehyde sulfonates, polymerisates of propylene oxide and/or ethylene oxide, including their copolymerisates and block copolymerisates, styrene-maleic acid and/or vinyl ether-maleic acid copolymerisates. Quite especially preferred are synthetic organic polymers, in particular partially saponified, optionally modified, polyvinyl alcohols with a degree of hydrolysis of 80 to 98 mol. % and a Höppler viscosity as 4% aqueous solution of 1 to 50 mPas and/or polyvinyl pyrrolidone.

The use of one or more cellulose ethers is also preferred. They can e.g. be selected from the group of alkyl hydroxyalkyl cellulose ethers and/or alkyl cellulose ethers, but can also contain some further modification. The alkyl groups of the alkyl hydroxyalkyl cellulose ethers and/or alkyl cellulose ethers are preferably methyl, ethyl and/or propyl groups and the hydroxyalkyl groups of the alkyl hydroxyalkyl cellulose ether are preferably hydroxymethyl, hydroxyethyl and/or hydroxypropyl groups. Their Brookfield viscosity measured at 20 rpm and as a 2% aqueous solution at 20° C. is preferably approximately 100 to 100,000 mPas, particularly approximately 1,000 to 75,000 mPas, and in a particularly preferred manner approximately 5,000 to 50,000 mPas.

The polyalkylene glycol that can be used is preferably a polyethyleneglycol. In one embodiment it has a molecular weight of more than 600, preferably more than 1,000, more preferably more than 2,000, most preferably more than 10,000.

In one embodiment of the present invention, the GLDA-containing particle is not only separated from the environment by a suitable coating, but additionally the GLDA-containing particle is structured with a suitable structurant. Accordingly, the particles of the invention may optionally comprise structurants which improve the physical strength of the particle.

The (structured) particles have many useful functions and can be employed in many different areas, frequently connected with applications in which the chelating agent contents of the particle have to be released into the surrounding environment under controlled conditions.

The structurant can include several salts and/or inorganic additives which contribute to the strength of the resulting particles and which also function as sequestration materials or as builders. The building salts found to be functional as a structurant for the chelating agents are citrate, carbonate, silicate, and sulfate salts. Preferably, the sodium salts of materials are used. Of these salts, sodium carbonate, sodium citrate, and sodium silicate are preferred due to their functionality (e.g. as a scale-inhibiting additive). Alternatively, inorganic (nano-) particles, such as silica, can be used.

The particles of the invention in one embodiment contain 15 to 90 wt % of the GLDA and optionally other chelating agents, 0 to 40 wt % of the structurant, and 5 to 85 wt % of the coating. In a preferred embodiment they contain 20 to 80 wt % of the GLDA and optionally other chelating agents, 0 to 20 wt % of the structurant, and 20 to 80 wt % of the coating, the total amounts of ingredients adding up to 100 wt %.

The particles of the invention in one embodiment have a particle size of 100 to 3,000 microns (μm), preferably of 200 to 2,000 microns, most preferably 500-1,000 microns.

Suitable processes to apply the coating on the particle in accordance with the process of the invention are for example disclosed in the *Kirk Othmer Encyclopedia of Chemical Technology, Vol* 16, *Microencapsulation*, pages 438-463 by C. Thies; JohnWiley&Sons Inc. 2001 and include, but are not limited to, the following processes:

"Spray-dry encapsulation processes which involves spraying an intimate mixture of core and shell material into a heated chamber where rapid desolvation occurs."

"Fluidized-bed encapsulation technology which involves spraying shell material in solution or hot melt form onto solid particles suspended in a stream of heated gas, usually air. Although several types of fluidized-bed units exist, so-called top and bottom spray units are used most often to produce microcapsules.

In top-spray units, hot melt shell materials are sprayed onto the top of a fluidized-bed of solid particles. The coated particles are subsequently cooled producing particles with a solid shell. This technology is used to prepare a variety of encapsulated ingredients. In bottom-spray or Wurster units the coating material is sprayed as a solution into the bottom of a column of fluidized particles. The freshly coated particles are carried away from the nozzle by the airstream and up into the coating chamber where the coating solidifies due to evaporation of solvent. At the top of the column or spout, the particles settle. They ultimately fall back to the bottom of the chamber where they are guided once again by the airstream past the spray nozzle and up into the coating chamber. The cycle is repeated until a desired capsule shell thickness has been reached. Coating uniformity and final coated particle size are strongly influenced by the nozzle(s) used to apply the coating formulation. This technology is routinely used to encapsulate solids, especially pharmaceuticals (qv). It can coat a wide variety of particles, including irregularly shaped particles. The technology generally produces capsules >100-150 mm, but can produce coated particles <100 mm."

In yet another example of a coating process, the coated particles are prepared by spraying the coating on the particle using a fluid bed coating process as for example described by E. Teunou, D. Poncelet, "Batch and continuous fluid bed coating review and state of the art", *J. Food Eng.* 53 (2002), 325-340. In the conventional fluidized bed process, the fluidized bed is a tank with a porous bottom plate. The plenum below the porous plate supplies low pressure air uniformly across the plate, leading to fluidization. The process comprises the following steps:

(a) a compound to be encapsulated in the form of a powder is fluidized with air at an air inlet temperature below the melting temperature of the powder;

(b) a coating liquid comprising a water based coating solution is sprayed onto the powder via a nozzle, followed by subsequent evaporation of the water by using elevated temperatures in the fluid bed. This leaves behind a coating layer on the particles with the compound in the core.

Suitable processes to prepare the intermediate particle according to the invention encompass methods like preparing a solution containing GLDA having a pH of between 4 and 11 (when measured as a 1% solution) and drying it.

A solution of GLDA having a pH of between 4 and 11 can be prepared by adding a base or an acid to an aqueous solution containing $H_4$-GLDA or $Y_4$-GLDA (Y having the same meaning as above), by using an ion exchange resin to set the pH thereof, or by electrodialytically (de)acidifying a solution of $H_4$-GLDA or $Y_4$-GLDA, such as is disclosed in WO2008/065109, the contents of which are incorporated herein by reference.

Drying the solution can be done by any drying method known to the person skilled in the art, for instance by evaporating the water via e.g. spray drying, fluid bed spray drying, fluid bed granulation.

The dry material may optionally be further processed, for example by compacting and/or crushing the material until it has the desired shape, i.e. is in the form of core particles of the desired size.

The step of compacting includes any method wherein the particles are agglomerated by applying an external force on them, for instance by tabletting or agglomerating them under a pressure of suitably from 40 to 200 MPa, preferably a pressure of from 50 to 120 MPa, most preferably of from 75 to 100 MPa.

The pressure used for compacting the material is the pressure applied at uniaxial compaction of a tablet (leading to a certain density of the compacted particle mixture). However, compacting may suitably be done by other compactors, like a roll compactor. In such cases, the pressure to be used is the pressure that results in the same density of the compact as in uniaxial compaction.

The step of crushing includes any method whereby the size of the particles is decreased and is intended to include methods like breaking, crushing, or milling.

In a preferred embodiment of the invention, the process to prepare the coated particles encompasses the preparation of a (co-)granule that is subsequently coated in a fluid bed coating process. The (co-)granule preparation is started by dissolving GLDA in water together with the coating material and, if required, a structurant. This mixture is sprayed into a hot spray drying chamber, leading to the evaporation of water. The particles formed this way are recirculated in the spray chamber and at the same time spraying the water based mixture into the chamber is continued, due to which the particle grows and a (co-)granule is gradually formed. The composition gradient inside the (co-)granule can be modified by altering the composition of the spray mix while spraying it into the drying chamber. This means that the core of the particle can be higher in GLDA concentration, whereas the outer part of the particle is enriched with the coating material. The particle formed is described as a co-granule, as it consists of the compound, the coating material, and, if required, a structurant. The obtained co-granule is subsequently coated in a fluid bed process. The coating material used in this latter step can be, but does not have to be, the same material as used in the spray granulation step. In this process, a powder is fluidized with warm air and a water based coating solution is sprayed onto the powder. The water is evaporated, leaving behind a coating on the particle surface. The amount of coating can be controlled easily by manipulating the spray on time.

EXAMPLES

The materials used are:

Dissolvine® GL-Na-40-S (a 40 wt % solution of GLDA monosodium salt in water)

Dissolvine® GL-47-S (a 47 wt % solution of GLDA tetrasodium salt in water, containing a little (+/−1 wt %) of free NaOH), both ex Akzo Nobel Functional Chemicals LLC, Chicago Ill. USA Alcoguard® 4160 (copolymer of maleic acid/acrylic acid/methyl methacrylate/2-acrylamido-2-methyl propane sulfonic acid at 25/64.5/4.5/6 mole percent as the sodium salt) ex Akzo Nobel Surface Chemistry LLC, Chicago Ill. USA.

Example 1 pH Effect on Moisture Uptake for Pure GLDA Material

A 40 wt % solution of GL-Na-40-S (at pH=3) was spray dried on a pilot spray drying unit (GEA/NIRO Mobile Minor™ 2000) using air inlet temperatures of about 150° C. In such a spray drying unit droplets are atomized and dried quickly. The residence time in such a spray drying unit is therefore much shorter (of the order of tens of seconds) than in a fluid bed granulator, where the residence time will be of the order of tens of minutes. This gave a fine, free flowing non-sticky powder. Pure GLDA granules were made by first mixing of GL-47-S/GLNa-40-S at a ratio of 85/15 (having a pH in a 1% solution of about 10). The mixture was sprayed into a fluid bed spray granulator AGT, equipped with cyclones, an external filter unit, and a scrubber, to give stable and free flowing granules with particle sizes between 100-5,000 microns. During the spray granulation process, the air flow was kept between 700-1,300 $m^3$/hour and air inlet temperatures of between 100 and 250° C. were used.

The above powder and granules were both stored in a climate chamber at 16° C., 60% RH to measure moisture absorption.

The weight of the powder was measured at the start (t=0) and after certain time steps. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

The results of those measurements for the three powders are given below in Table 1 and FIG. 3.

Figure 3:
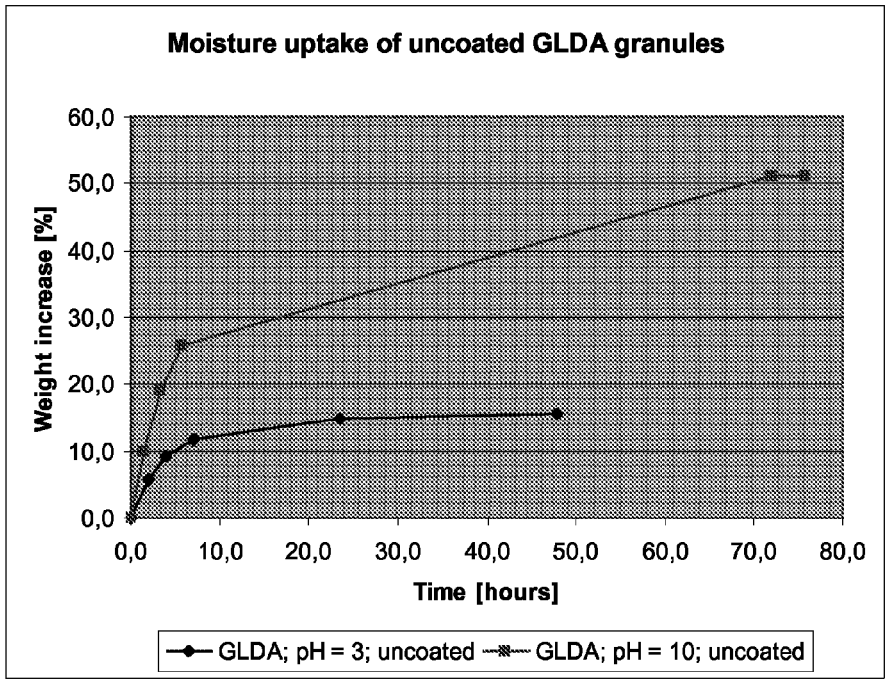
FIG. 3: A graph of the moisture uptake of uncoated GLDA granules in accordance with Example 1.

Table 1 and FIG. 3 show clearly that a low pH GLDA solution made into a pure GLDA powder gives a reduced rate of moisture uptake.

TABLE 1

| Moisture absorption at 16 C., 60% RH | | | |
|---|---|---|---|
| GLDA; pH = 3; Uncoated | | GLDA; pH = 10; uncoated | |
| Time [hrs] | wt % increase | Time [hrs] | wt % increase |
| 0.0 | 0.0 | 0.0 | 0.0 |
| 2.0 | 5.8 | 1.5 | 9.9 |
| 4.0 | 9.1 | 3.4 | 19.0 |
| 7.0 | 11.8 | 5.8 | 25.7 |
| 23.5 | 14.8 | 71.9 | 51.2 |
| 48.0 | 15.7 | 75.8 | 51.0 |

The above shows that a lower pH (pH of 3) is preferred over a higher pH (pH of 10) from a moisture uptake perspective.

Example 2 pH Effect on Moisture Uptake for Co-Granule

Two co-granules were produced via a granulation process. The co-granule preparation was started with a mixture of GLDA in solution into which Alcoguard4160 was mixed. This mixture was sprayed into a hot spray drying chamber, leading to the evaporation of water. The particles formed this way were recirculated in the spray chamber and at the same time spraying the water based mixture into the chamber was continued, due to which the particle grew and a granule was gradually formed. The mixture was continuously sprayed into a fluid bed spray granulator type AGT, equipped with cyclones, an external filter unit, and a scrubber. During the spray granulation process, the air flow was kept between 700-1300 m3/hour and air inlet temperatures of between 100 and 250° C. were used. This resulted in a free flowing powder.

The following co-granules were produced that way:

1) One co-granule consisted of GL-47-S and GL-Na-40-S in a ratio of 95:5, which was co-granulated with the scale-inhibiting polymer Alcoguard® 4160, where a total of 20 wt % polymer was used on dry granule basis. This corresponds with a pH of about 9.8 (n is about 0.3) when a 1 wt % solution in water is prepared.
2) The second co-granule consisted of GL-47-S and GL-Na-40-S in a ratio of 50:50, which was co-granulated with the scale-inhibiting polymer Alcoguard® 4160, where a total of 20 wt % polymer was used on dry granule basis. This corresponds with a pH of about 5 (n is about 2.4) when a 1 wt % solution in water is prepared.

The resulting powders were put into a climate chamber at 16° C., 60% Relative Humidity. The weight of the powder was measured at the start (t=0) and after certain time steps. The weight increase was recomputed into a % weight increase by using the following formula: Weight % increase at time t=[Weight (at t=0)−Weight (at time t)]/[Weight (at t=0)]. The results of those measurements are given below in Table 2.

TABLE 2

| Moisture absorption at 16 C., 60% RH | | | |
|---|---|---|---|
| Co-Granule 1 pH = 5 (uncoated) | | Co-Granule 2 pH = 9.8 (uncoated) | |
| Time [hrs] | wt % increase | Time [hrs] | wt % increase |
| 0.0 | 0.0 | 0.0 | 0.0 |
| 2.4 | 12.2 | 1.5 | 9.7 |
| | | 3.4 | 18.2 |
| 5.4 | 21.2 | 5.8 | 24.5 |

Co-granule 1 composition: (GL47-S/GL-Na-40-S [50:50])/Alcoguard4160 (80:20) Co-granule 2 composition: (GL47-S/GL-Na-40-S [95:5])/Alcoguard4160 (80:20)

More specifically, from the table above the following can be computed:

Rate of Moisture Absorption in the First 6 Hours:

pH=5: 3.92 [%/hr]

pH=9.8: 4.22 [%/hr]

The results shown above indicate that the rate of moisture uptake for the low pH core is slower, hence even after making a co-granule thereof with another material a low pH is preferred to avoid moisture uptake as much as possible.

Example 3 pH Modification Via Acidification by Acids and Effect on Moisture Uptake

Dissolvine® GL-47-S was acidified to a lower pH by adding two acid types: 96% sulfuric acid ($H_2SO_4$) and $CO_2$-ice. The reason to select these two acids was that they would generate $Na_2SO_4$ and $Na_2CO_3$ both salts that are used in dishwashing and laundry applications as filler and/or co-builder. The $CO_2$ dissolves in the water and lowers the pH by the formation of carbonic-acid. The pH obtained for the GLDA solution as such by adding solid $CO_2$ ice was 10. The pH's for the GLDA solutions as such that were obtained by adding various amounts of sulfuric acid were, respectively, 7, 4.2, and 3. The four solutions with a lowered pH were spray dried on a Buchi lab scale spray drier using air temperatures up to about 150° C. This gave fine and dry powders. Once the powders were produced, they were put into a climate chamber at 16° C., 60% Relative Humidity by creating a thin layer of powder in a petri dish which was placed in the chamber. The weight of the powder was measured at the start (t=0) and after certain time steps. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

Figure 4:
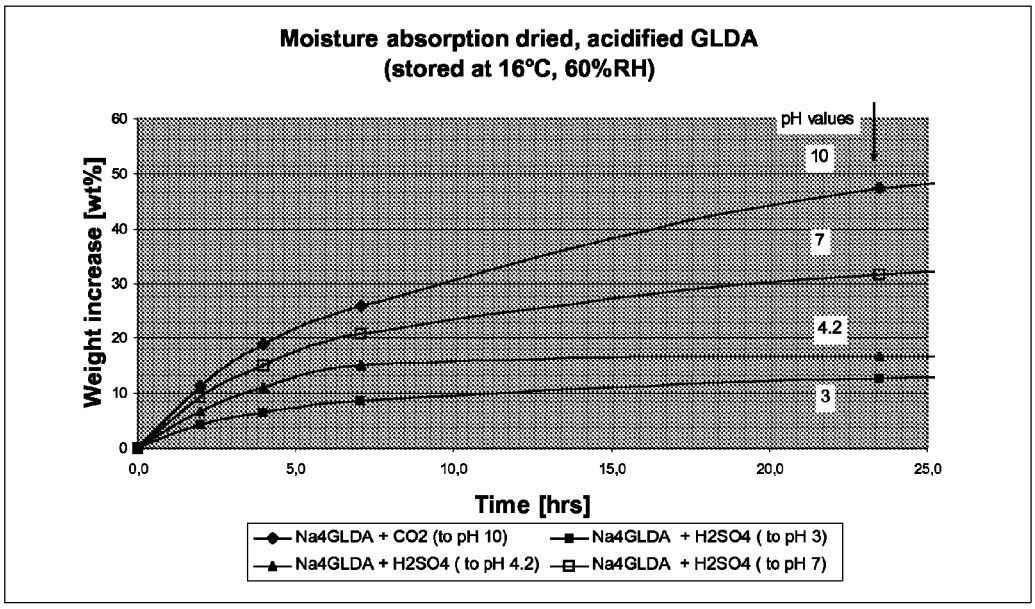
FIG. 4: A graph of the moisture absorption of dried, acidified GLDA in accordance with Example 3.

The results of those measurements for the four powders are given below in Table 3 and FIG. 4. Both the table and figure clearly show that the lower the pH, the lower the rate of moisture uptake and the lower the final absolute moisture uptake.

TABLE 3

| | Time (hours) | | | | |
|---|---|---|---|---|---|
| | 0 | 2 | 4 | 7 | 23.5 |
| Na4GLDA + H2SO4 (to pH 3) | 0 | 4.3 | 6.4 | 8.7 | 12.8 |
| Na4GLDA + H2SO4 (to pH 4.2) | 0 | 6.7 | 10.9 | 15.0 | 16.7 |
| Na4GLDA + H2SO4 (to pH 7) | 0 | 9.3 | 15.0 | 20.9 | 31.5 |
| Na4GLDA + CO2 (to pH 10) | 0 | 11.3 | 19.0 | 25.7 | 47.4 |

Example 4 pH Modification Via Acidification by an Electrochemical Process and Effect on Moisture Uptake A GLDA solution made of 95 vol % Dissolvine® GL-47-S and 5 vol % Dissolvine® GL-Na-40-S, to which some water was added to make an about 35 wt % solution, was acidified to a lower pH using a Bi-Polar Membranes (BPM) process. In a BPM process, a bipolar membrane electrodialysis stack is used as described in WO 2008/065109. Such a unit consists of bipolar membranes and a cation exchange membrane. The sodium cations are removed though the cationic exchange membrane, while the hydrogen is added into the product stream via an electrochemical reaction. That way the solution is gradually acidified without having residual sodium cations present. This means that a "salt free" acidification has occurred.

The experimental set-up consisted of three vessels to recycle fluids through the BPM unit. The temperature was controlled by applying heating/cooling to the jacketed reactors. The acid reactor is a 1 l stirred glass reactor and the base and electrolyte loop both used 1.5 l glass reactors without stirring. Nitrogen was passed through the electrolyte solution via a gas sparger in order to dilute the hydrogen gas produced at the cathode far below the explosion limit.

The reactor was charged with the above ca. 35 wt % GLDA solution and the recirculation of the reactor content over the BPM stack was started. Once the GLDA-solution was heated to 40° C., an electric current was applied. The voltage (V) over the stack was limited to 25V and the electric current (I) was controlled manually to a maximum of 15 A. When the desired pH was reached, the current to the BPM was minimized and both the reactor and the BPM contents were collected.

The process was controlled such that two solutions were obtained with a pH as such of 7 and 3, respectively. Both solutions were spray dried on a Büchi lab scale spray drier using air Inlet temperatures of 220° C. and outlet temperatures varying between 120 and 130° C. This gave fine and dry powders. Once the powders were produced, they were put into a climate chamber at 16° C., 60% Relative Humidity by creating a thin layer of powder in a petri dish which was placed in the chamber. The weight of the powder was measured at the start (t=0) and after certain time steps. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

The results of those measurements for the three powders are given below in Table 4 and FIG. 5.

Figure 5:
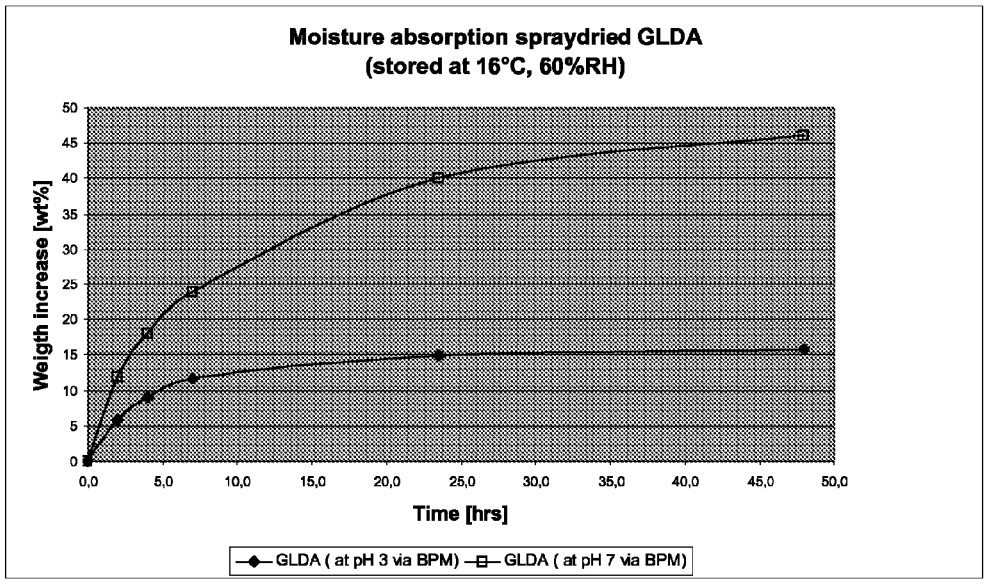
FIG. 5: A graph of the moisture absorption of spraydried GLDA in accordance with Example 4.

Both Table 4 and FIG. 5 clearly show that the lower the pH, the lower the rate of moisture uptake and the lower the final absolute moisture uptake.

TABLE 4

| | Time (hours) | | | | | |
|---|---|---|---|---|---|---|
| | 0 | 2 | 4 | 7 | 23.5 | 48 |
| GLDA (at pH 3 via BPM) | 0 | 5.8 | 9.1 | 11.8 | 14.8 | 15.7 |
| GLDA (at pH 7 via BPM) | 0 | 11.8 | 18.0 | 23.9 | 40.0 | 46.1 |

Example 5

Effect of pH on Formation of Granules in Spray Granulation Process

Solutions of GL-47-S and GL-Na-40-S were mixed at various ratios to control the pH of the final solution. Ratios that were used and the corresponding pH, as such and remeasured in a 1% solution, were:

TABLE 5

| Mix # | Ratio GL-47-S/GL-Na—40S | pH (as such) | pH (1% soln) |
|---|---|---|---|
| 1 | 100/0 | 13.8 | 11.5 |
| 2 | 95/5 | 13.4 | 11.0 |
| 3 | 85/15 | 8.8 | 9.8 |
| 4 | 50/50 | 5 | 5.2 |
| 5 | 0/100 | 3 | 3.2 |

These mixtures were sprayed into a fluid bed spray granulator AGT, equipped with cyclones, an external filter unit, and a scrubber. During the spray granulation process, the air flow was kept between 700-1,300 $m^3$/hour and air inlet temperatures between 100 and 250° C. were used.

It was found that stable and free flowing granules with particle sizes between 100-5,000 microns could only be obtained for mixtures 2, 3, and 4. When a solution of GLDA of a pH of 3 was used, no free flowing granules could be obtained, as the resulting powder was too sticky already at inlet air temperatures below 100 to 80° C. The material made from a solution having a pH of above 11 (for 1% sol.) consisted of particles too brittle to coat, as they fell apart trying to do so. The mixture 2 in which at minimum all the free caustic normally present in Dissolvine® GL-47-S was neutralized, that has a pH of about 11 in a 1% solution, and thus is on the edge of the present invention, was already better to handle than mixture 1, which mixture 1 was clearly too brittle to coat. Though low pH is thus preferred for low moisture uptake properties, obtaining physically stable (co-)granules and subsequently coating such low pH particles was found to be impossible due to stickiness. Coating GLDA material with a high pH is also troublesome due to the lack of particle coherence and hence strength.

Example 6

Three types of granules were made on the basis of GLDA (Dissolvine® GL-47-S and Dissolvine® GL-Na-40-S). The process to prepare the coated particles encompasses the preparation of a granule that is subsequently coated in a fluid bed coating process. The granule preparation was started with a GLDA solution in water into which the coating material was mixed as described below for one material. This mixture was sprayed into a hot spray drying chamber, leading to the evaporation of water. The particles formed this way were recirculated in the spray chamber and at the same time spraying the water based mixture into the chamber was continued, due to which the particle grew and a granule was gradually formed. The obtained granule was subsequently coated in a fluid bed process. In this process, the powder was fluidized with warm air and a water based coating solution was sprayed onto the powder. The water was evaporated, leaving behind a coating on the particle surface. The amount of coating was controlled by manipulating the spray-on time.

Powder A consisted of pure GLDA. Powder A was formed by mixing GL-47-S and GLNa-40-S in a 85:15 ratio, which equals an aqueous solution containing HnYm-GLDA wherein n is 0.3 (the pH measured as a 1% solution was found to be about 9.8). This mixture was continuously sprayed into a fluid bed spray granulator type AGT, equipped with cyclones, an external filter unit, and a scrubber. During the spray granulation process, the air flow was kept between 700-1,300 $m^3$/hour and air inlet temperatures between 100 and 250° C. were used. This resulted in a free flowing powder.

For powder B the same procedure was used as for powder A, except that the spray mix now consisted of GL-47-S and GL-Na-40-S in a 95:5 ratio mixed with anti-scaling polymer Alcoguard® 4160, where the ratio of total GLDA and Alcoguard® 4160 was 80:20. As Alcoguard® 4160 is acidic, the pH of a 1 wt % dissolved granule is ~9.8, which corresponds with HnYm-GLDA wherein n is 0.3. Powder B was made via spray granulation to form a co-granule (powder B, represented by FIG. 1). Powder B represents a plain mixture of GLDA and Alcoguard® 4160.

Powder C is a coated particle of the pure GLDA granule powder A described above coated with 20% Alcoguard® 4160 in a fluid bed. Powder C was produced by coating powder A with an Alcoguard® 4160 solution (about 45 wt % solution) in a GEA Aeromatic Strea-1 lab scale fluid bed coater, using a Würster set-up and a two-fluid nozzle. The air inlet temperature used to evaporate the water from the Alcoguard® 4160 solution was 80° C. The air flow was chosen such that visually an even fluidization was obtained, which meant a setting between 10 and 80% of the maximum air flow on the GEA Aeromatic Strea-1. The spray-on rate of the coating was chosen such that an even coating was obtained on the particles giving no particle aggregation (i.e. about 0.5 gram/minute), resulting in a particle structure represented by FIG. 2C. Spray coating was continued until 20 wt % (on dry basis) of Alcoguard® 4160 was coated onto the GLDA particle.

Once the powders were produced, they were put into a climate chamber at 16° C., 60% Relative Humidity. The weight of the powder was measured at the start (t=0) and after certain time steps. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

The results of those measurements for the three powders are given below in Table 6 and FIG. 6.

TABLE 6

| Time [hours] | Powder A wt % water | Powder B wt % water | Time [hours] | Powder C Wt % water |
|---|---|---|---|---|
| 0.0 | 0.0 | 0.0 | 0.0 | 0.0 |
| 1.5 | 9.9 | 9.7 | 1.0 | 1.9 |
| | | | 2.7 | 5.8 |
| 3.4 | 19.0 | 18.2 | 3.8 | 9.0 |
| 5.8 | 25.7 | 24.5 | 6.5 | 15.7 |

Figure 6:
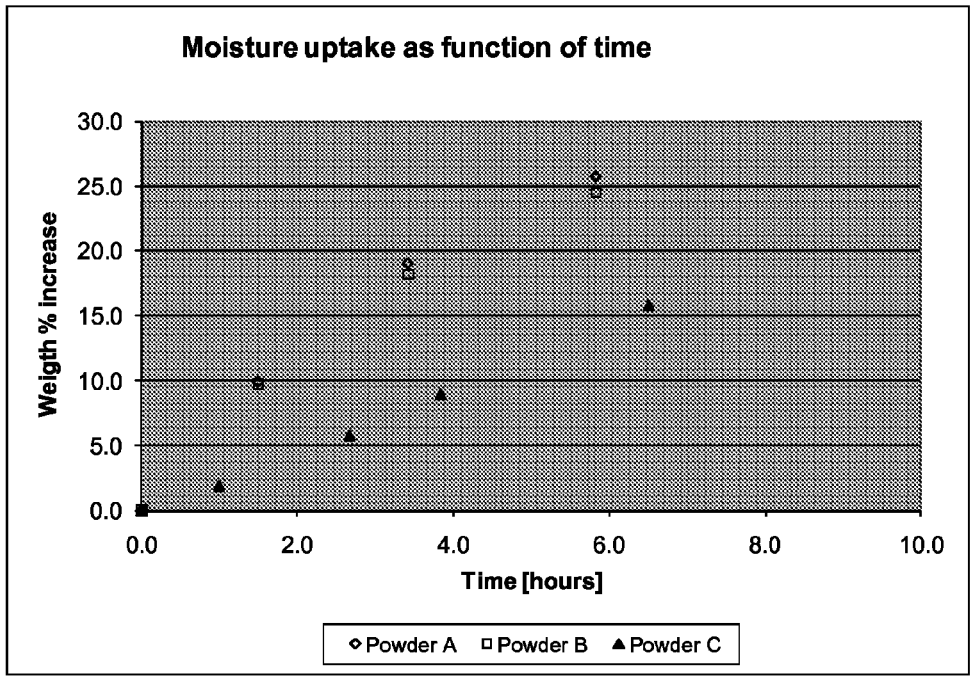
FIG. 6: A graph of the moisture uptake as a function of time for three different powders in accordance with Example 6.

FIG. 6 shows especially the results for the first 6 hours of storage, as this best exemplifies the rate of moisture pick-up for the three powders.

The results show that in all cases a free flowing powder can be obtained, again showing that using the adequate pH for the spray solution results in a physically stable particle.

When comparing the results for powders A and B, Table 6 and FIG. 6 show that the pure granule (powder A) and the mixture (powder B) have no significantly different behaviour in moisture absorption at identical pH-values of the spray solution. This indicates that a matrix-type structure as made in powder B, does not give a significant delay in moisture uptake. When a true core-shell structure, i.e. a coated particle, is used (powder C), one can clearly see from the table and the figure that this does give a delayed moisture uptake. This effect is thought to be due to the coating layer applied, as well as due to the fact that the coating is acidic, making the coated particle slightly more acidic than powder B when in contact with water or moisture. Also, this Example demonstrates that coating the particles according to the invention can be done without any problem.

Example 7

Coating of GLDA Co-Granules with Polyvinyl-Alcohol

Co-granules of GLDA and Alcoguard® 4160 were produced in a spray granulation process. Three types of granules were made on the basis of GLDA (Dissolvine® GL-47-S and Dissolvine® GL-Na-40-S, anti-scaling polymer Alcoguard® 4160, and the water-soluble polyvinyl-alcohol Mowiol 3-85 (available from Kuraray Europe GmbH)). The process to prepare the coated particles encompassed the preparation of a granule that was subsequently coated in a fluid bed coating process. GL-47-S and GL-NA-40-S were mixed in a ratio of 95:5 to which Alcoguard® 4160 (also abbreviated as "4160") was added, wherein the GLDA/4160 ratio was 80:20, corresponding with a pH of about 9.8 and a value for n of about 0.3. This mixture was sprayed into a hot spray drying chamber, leading to the evaporation of water. The particles formed this way were recirculated in the spray chamber and at the same time spraying the water based GLDA/4160 mixture into the chamber was continued, due to which the particle grew and a granule was gradually formed. The particle formed is described as a co-granule, as it consisted of GLDA and the anti-scaling polymer.

The mixture of GLDA and 4160 was continuously sprayed into a fluid bed spray granulator type AGT, equipped with cyclones, an external filter unit, and a scrubber. During the spray granulation process, the air flow was kept between 700-1,300 $m^3$/hour and air inlet temperatures between 100 and 250° C. were used. This resulted in a free flowing powder, described as "uncoated".

The uncoated GLDA/4160 co-granule was subsequently coated in a fluid bed (GEA Aeromatic Strea-1) with Mowiol 3-85, using a 16% Mowiol solution in water and using a Würster set-up and a two-fluid nozzle. The air inlet temperature used was 80° C. The air flow was chosen such that visually an even fluidization was obtained, which implies a setting between 10 and 80% of the maximum air flow on the GEA Aeromatic Strea-1. The spray-on rate of the Mowiol solution was chosen such that an even coating was obtained on the particles giving no particle aggregation (i.e. about 0.5 gram/minute), resulting in a particle coated with an even polyvinyl-alcohol film. The amount of Mowiol 3-85 sprayed on was varied between about 10 wt % and 20 wt % (on dry basis).

The resulting powders were all stored in a climate chamber operated at 16° C. and 60% Relative Humidity. The weight increase as a function of time was measured, as a measure for the rate of absorption of moisture. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

Figure 7:
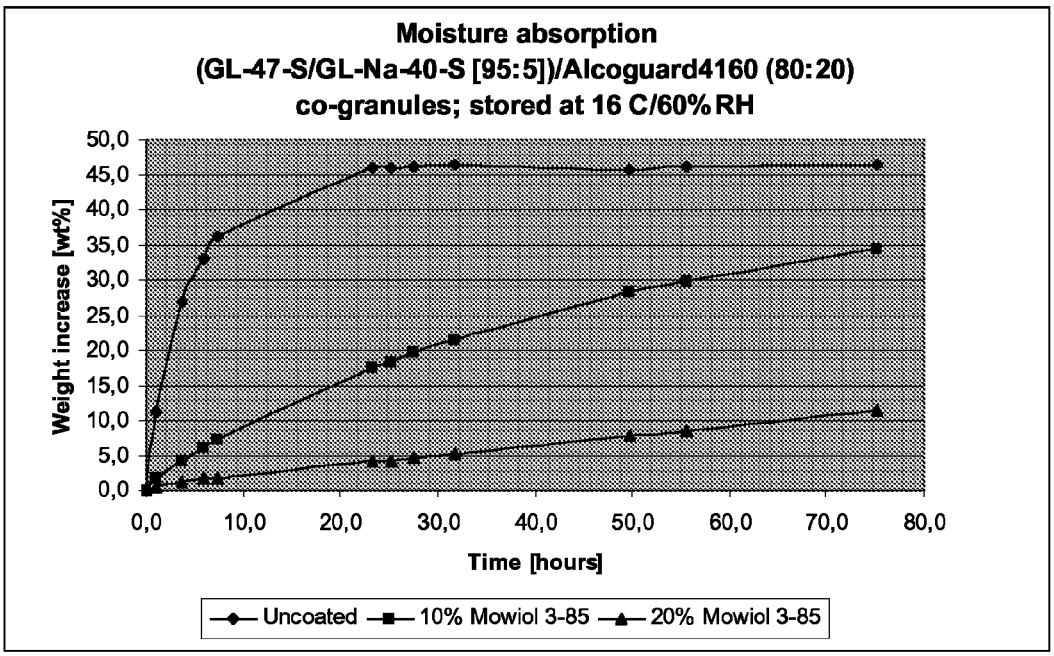
FIG. 7: A graph of the moisture absorption of uncoated and coated GLDA granules in accordance with Example 7.

The results of the measurements are given below in Table 7 and FIG. 7. The table and the figure clearly show that coating the particles according to the invention can be done without any problem and that a coating layer of Mowiol 3-85 gives a delayed effect on moisture absorption, and the higher the level of Mowiol 3-85, the slower the moisture uptake.

TABLE 7

| Time [hours] | [GL47S/GLNa40S (95:5)]/4160 (80:20) uncoated wt % water | [GL47S/GLNa40S (95:5)]/4160 (80:20) + 10% Mowiol coating wt % water | [GL47S/GLNa40S (95:5)]/4160 (80:20) + 20% Mowiol coating wt % water |
|---|---|---|---|
| 0.0 | 0.0 | 0.0 | 0.0 |
| 1.0 | 11.2 | 1.6 | 0.5 |
| 3.7 | 26.7 | 4.0 | 1.2 |
| 6.0 | 33.0 | 6.0 | 1.6 |
| 7.5 | 36.0 | 7.3 | 1.8 |
| 23.3 | 45.8 | 17.6 | 4.1 |
| 25.3 | 45.9 | 18.2 | 4.1 |
| 27.6 | 46.2 | 19.7 | 4.7 |
| 31.8 | 46.2 | 21.5 | 5.2 |
| 49.8 | 45.7 | 28.3 | 7.7 |
| 55.6 | 46.2 | 29.7 | 8.6 |
| 75.2 | 46.4 | 34.4 | 11.4 |

Example 8

Coating of Pure GLDA Granules with Polyvinyl-Alcohol

Granules of GLDA were produced in a spray granulation process. Three types of granules were made on basis of GLDA (Dissolvine® GL-47-S and Dissolvine® GL-Na-40-S available from Akzo Nobel Functional Chemicals LLC, Chicago Ill. USA) and the water-soluble polyvinyl-alcohol Mowiol 3-85 (available from Kuraray Europe GmbH). The process to prepare the coated particles encompassed the preparation of a granule that was subsequently coated in a fluid bed coating process. GL-47-S and GL-Na-40-S were mixed in a ratio of 85:15, corresponding with a pH of about 9.8 and a value of n of about 0.3. This mixture was sprayed into a hot spray drying chamber, leading to the evaporation of water. The particles formed this way were recirculated in the spray chamber and at the same time spraying the water based GLDA solution into the chamber was continued, due to which the particle grew and a granule was gradually formed.

The GLDA solution was continuously sprayed into a fluid bed spray granulator type AGT, equipped with cyclones, an external filter unit, and a scrubber. During the spray granulation process, the air flow was kept between 700-1,300 $m^3$/hour and air inlet temperatures between 100 and 250° C. were used. This resulted in a free flowing powder, described as uncoated.

The uncoated GLDA granule was subsequently coated in a fluid bed (GEA Aeromatic Strea-1) with Mowiol 3-85, using a 16% Mowiol solution in water and using a Würster set-up and a two-fluid nozzle. The air inlet temperature used was 80° C. The air flow was chosen such that visually an even fluidization was obtained, which implies a setting between 10 and 80% of the maximum air flow on the GEA Aeromatic Strea-1. The spray-on rate of the Mowiol solution was chosen such that an even coating was obtained on the particles giving no particle aggregation (i.e. about 0.5 gram/minute), resulting in a particle coated with an even polyvinyl-alcohol film. The amount of Mowiol 3-85 sprayed on was varied between about 10 wt % and 20 wt % (on dry basis).

The resulting powders were all stored in a climate chamber operated at 16° C. and 60% Relative Humidity. The weight increase as a function of time was measured, as a measure for the rate of absorption of moisture. The weight increase was recomputed into a % weight increase by using the following formula:

$$\text{Weight \% increase at time } t = [\text{Weight (at } t=0) - \text{Weight (at time } t)]/[\text{Weight (at } t=0)].$$

Figure 8:
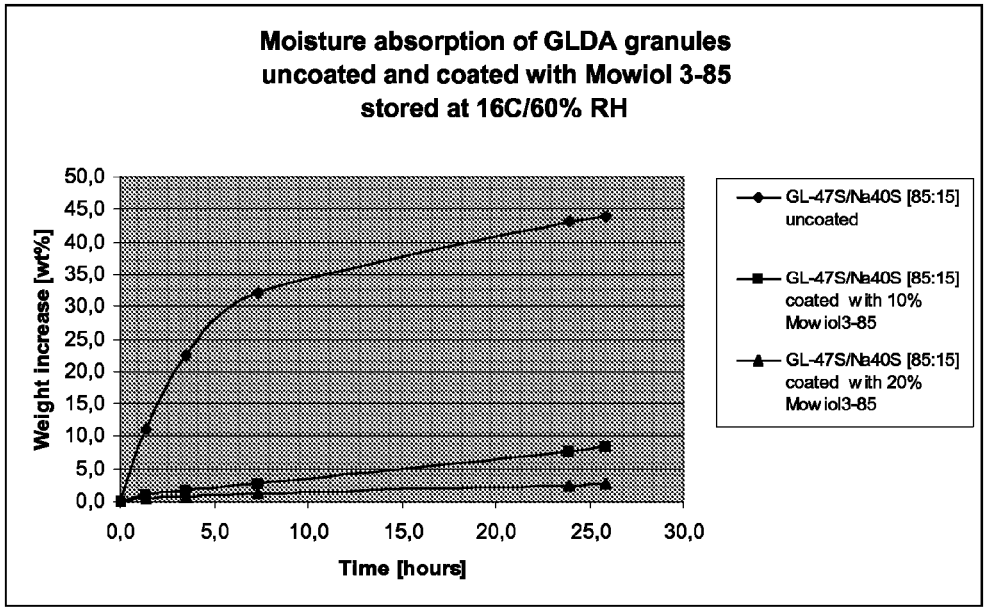
FIG. 8: A graph of the moisture absorption of uncoated and coated GLDA granules in accordance with Example 8.

The results of those measurements are given below in Table 8 and FIG. 8. The table and the figure clearly show that coating the particles according to the invention can be done without any problem and that a coating layer of Mowiol 3-85 gives a delayed effect on moisture absorption, and the higher the level of Mowiol 3-85, the slower the moisture uptake.

TABLE 8

| Time [hours] | GL-47S/Na40S [85:15] uncoated wt % water | GL-47S/Na40S [85:15] coated with 10% Mowiol3-85 wt % water | GL-47S/Na40S [85:15] coated with 20% Mowiol3-85 wt % water |
|---|---|---|---|
| 0.0 | 0.0 | 0.0 | 0.0 |
| 1.3 | 11.2 | 1.1 | 0.5 |
| 3.5 | 22.4 | 1.8 | 0.8 |
| 7.3 | 32.0 | 2.6 | 1.2 |
| 23.9 | 43.1 | 7.5 | 2.4 |
| 25.9 | 43.9 | 8.5 | 2.6 |

The invention claimed is:

1. Process to prepare coated particles containing a particle and a coating, wherein the particle comprises a partial salt of glutamic acid N,N-diacetic acid of the formula HnYm-GLDA, wherein Y is a cation, selected from the group of sodium, potassium, lithium, and mixtures thereof, n+m=4, and wherein 0.1 to 3.2 hydrogen cations are available per GLDA anion in which the particle is made from a solution containing the partial salt of glutamic acid N,N-diacetic acid that has a pH of between 4 and 11 when measured as a 1% solution in water, and subsequently or simultaneously the coating is applied on the particle.

2. The process to prepare coated particles of claim 1 comprising the steps of first making a particle containing HnYm-GLDA by preparing a solution containing GLDA having a pH of between 4 and 11 when measured as a 1% solution in water, and thereafter applying a drying step, and subsequently applying the coating thereon.

3. Coated particle containing a particle and a coating, wherein the particle comprises a partial salt of glutamic acid N,N-diacetic acid of the formula HnYm-GLDA, wherein Y is a cation, selected from the group of sodium, potassium, lithium, and mixtures thereof, n+m=4 and wherein 0.1 to 3.2 hydrogen cations are available per GLDA anion.

4. Coated particle of claim 3 additionally comprising a structurant.

5. Coated particle of claim 3 wherein the coating contains a compound of the group of scale-inhibiting additives, anti-blocking agents, protective colloids, and other water-soluble polymers.

6. A detergent, an agricultural composition, an oil field composition or a water treatment composition comprising the coated particle of claim 3.

7. Coated particle of claim 4 wherein the coating contains a compound of the group of scale-inhibiting additives, anti-blocking agents, protective colloids, and other water-soluble polymers.

8. A detergent, an agricultural composition, an oil field composition or a water treatment composition comprising the coated particle of claim 4.

9. A detergent, an agricultural composition, an oil field composition or a water treatment composition comprising the coated particle of claim 5.

* * * * *